US011540968B2

(12) United States Patent
Christensen et al.

(10) Patent No.: US 11,540,968 B2
(45) Date of Patent: Jan. 3, 2023

(54) HEADREST FOR SURGICAL CHAIRS

(71) Applicants: Kyle Christensen, Holladay, UT (US); Jessica Bunderson, South Jordan, UT (US)

(72) Inventors: Kyle Christensen, Holladay, UT (US); Jessica Bunderson, South Jordan, UT (US)

( * ) Notice: Subject to any disclaimer, the term of this patent is extended or adjusted under 35 U.S.C. 154(b) by 0 days.

(21) Appl. No.: 17/164,414

(22) Filed: Feb. 1, 2021

(65) Prior Publication Data

US 2021/0244595 A1 Aug. 12, 2021

Related U.S. Application Data

(60) Provisional application No. 62/972,780, filed on Feb. 11, 2020.

(51) Int. Cl.
*A61G 15/12* (2006.01)
*A61G 15/02* (2006.01)

(52) U.S. Cl.
CPC ..... *A61G 15/125* (2013.01); *A61G 15/02* (2013.01)

(58) Field of Classification Search
USPC ..... 297/405
See application file for complete search history.

(56) References Cited

U.S. PATENT DOCUMENTS 457,059 A * 8/1891 Stuck ..... A61G 15/00 297/367 R
4,080,080 A * 3/1978 Cisler ..... F16B 7/1472 248/188.5
5,517,794 A * 5/1996 Wagner ..... E06B 1/363 52/717.03
5,895,428 A * 4/1999 Berry ..... A61F 2/4425 606/907
6,095,611 A * 8/2000 Bar ..... A61G 5/1067 297/284.3
6,419,321 B1 * 7/2002 Sack ..... A61G 5/12 297/405
8,641,147 B2 * 2/2014 Diller ..... A61G 15/125 297/400
8,844,536 B1 * 9/2014 Schuele ..... A61B 90/14 602/17
8,911,019 B2 * 12/2014 Josten ..... G05G 1/52 297/391
10,327,554 B2 * 6/2019 DuFresne ..... A61G 5/121
(Continued)

FOREIGN PATENT DOCUMENTS

GB 234332 A * 2/1925

*Primary Examiner* — David E Allred
(74) *Attorney, Agent, or Firm* — Parsons Behle & Latimer

(57) ABSTRACT

A headrest device may include a first plate, a second plate, and a locking mechanism, where the second plate is free to shift in any direction along a surface of the first plate while the locking mechanism is in an unlocked state, and where the second plate is prevented from shifting along the surface of the first plate when the locking mechanism is in a locked state. A method may include forming a first plate, forming a second plate, and attaching a locking mechanism to the second plate, where the second plate is free to shift in any direction along a surface of the first plate while the locking mechanism is in an unlocked state, and where the second plate is prevented from shifting along the surface of the first plate when the locking mechanism is in a locked state.

16 Claims, 6 Drawing Sheets

(56) References Cited

U.S. PATENT DOCUMENTS

| | | | | |
|---|---|---|---|---|
| 2004/0227049 | A1* | 11/2004 | Lang | B60R 1/066 248/476 |
| 2007/0272808 | A1* | 11/2007 | Schuerch | A61G 15/125 248/118 |
| 2014/0039644 | A1* | 2/2014 | Dillingham | A61F 2/64 623/36 |
| 2017/0296838 | A1* | 10/2017 | Asahina | A61G 15/125 |
| 2019/0274904 | A1* | 9/2019 | Jørgensen | F16M 13/00 |

* cited by examiner

HEADREST FOR SURGICAL CHAIRS

CROSS-REFERENCE TO RELATED APPLICATIONS

This application claims priority to, and the benefit of, U.S. Provisional Patent Application No. 62/972,780, filed Feb. 11, 2020, and entitled "Headrest for Surgical Chairs," the contents of which are incorporated by reference herein in their entirety.

FIELD OF THE DISCLOSURE

This disclosure is generally related to the field of headrests and, in particular, to an adjustable headrest for surgical chairs.

BACKGROUND

During operations for head, neck, and maxillofacial procedures, it may be desirable to ensure the stable positioning a patient's head. Further, in order to accommodate different patients and different procedures, easy adjustability of the positioning of the patient's head may also be helpful.

Typical surgical or operation chairs may rely on a "doughnut"-type cushioned headrest for stabilizing and positioning a patient's head. However, the adjustability of these typical headrests may be limited. In some cases, the headrests may be adjusted using hinges that can only be rotated along one axis. If multiple hinges are used, they are typically adjusted one at a time with separate actuating steps for each one. Other disadvantages may exist.

SUMMARY

Disclosed is a surgical chair headrest that allows flexion, extension, and side-to-side articulation. When unlocked, the headrest may be moved freely in any direction along a curved surface allowing a patient's head to be adjusted side-to-side, up-or-down, and at any angle up to a point of contact.

In an embodiment, a headrest device includes a center plate configured to attach to an extension arm. The device further includes an inner compression plate positioned on a first side of the center plate. The device also includes a padded headrest attached to the inner compression plate. The device includes an outer compression plate positioned on a second side of the center plate opposite the first side of the center plate. The device further includes a lever that is movable between a locked state and an unlocked state, where the lever applies a clamping force between the inner compression plate and the outer compression plate when in the locked state, where the inner compression plate is free to shift in any direction along a surface of the center plate while the lever is in the unlocked state, and where the inner compression plate is prevented from shifting along the surface of the center plate when the lever is in the locked state.

In some embodiments, the surface of the center plate is a concave surface, and shifting the inner compression plate along the surface of the center plate changes an angle between a principle axis of the center plate and a principle axis of the inner compression plate. In some embodiments, the device includes a clamping bolt passing through the outer compression plate and the inner compression plate, where the clamping force is applied to the outer compression plate and the inner compression plate through the clamping bolt. In some embodiments, the device includes a mounting member attached to the center plate, where the mounting member facilitates attaching the center plate to the extension arm. In some embodiments, the device includes a second mounting member attached to the center plate, where the mounting member and the second mounting member facilitate attaching the center plate to the extension arm at two points of attachment.

In an embodiment, a headrest device includes a first plate configured to attach to an extension arm. The device includes a second plate. The device further includes a locking mechanism, where the second plate is free to shift in any direction along a surface of the first plate while the locking mechanism is in an unlocked state, and where the second plate is prevented from shifting along the surface of the first plate when the locking mechanism is in a locked state.

In some embodiments, the device includes a padded headrest attached to the second plate. In some embodiments, the surface of the first plate is a concave surface, and shifting the second plate along the surface of the first plate changes an angle between a principle axis of the first plate and a principle axis of the second plate. In some embodiments, the device includes a third plate, where the second plate and the third plate are compression plates positioned on opposing sides of the first plate, and where the locking mechanism includes a lever configured to apply a clamping force between the second plate and the third plate while the locking mechanism is in the locked state. In some embodiments, the device includes a clamping bolt passing through the second plate and the third plate, where the clamping force is applied to the second plate and the third plate through the clamping bolt. In some embodiments, the device includes a mounting member attached to the first plate, where the mounting member facilitates attaching the first plate to the extension arm. In some embodiments, the device includes a second mounting member attached to the first plate, where the first mounting member and the second mounting member facilitate attaching the first plate to the extension arm at two points of attachment. In some embodiments, the extension arm is an articulating extension arm associated with a bed or chair.

In an embodiment, a method includes forming a first plate configured to attach to an extension arm. The method further includes forming a second plate. The method also includes attaching a locking mechanism to the second plate, where the second plate is free to shift in any direction along a surface of the first plate while the locking mechanism is in an unlocked state, and where the second plate is prevented from shifting along the surface of the first plate when the locking mechanism is in a locked state.

In some embodiments, the method includes attaching a padded headrest to the second plate. In some embodiments, the surface of the first plate is a concave surface, and shifting the second plate along the surface of the first plate changes an angle between a principle axis of the first plate and a principle axis of the second plate. In some embodiments, the method includes forming a third plate, where the second plate and the third plate are compression plates, and positioning the second plate and the third plate on opposing sides of the first plate, where the locking mechanism includes a lever configured to apply a clamping force between the second plate and the third plate while the locking mechanism is in the locked state. In some embodiments, the method includes passing a clamping bolt through the second plate and the third plate, where the clamping force is applied to the second plate and the third plate through the clamping bolt. In some embodiments, the method includes attaching a mounting member to the first plate, where the mounting member facilitates attaching the first plate to the extension arm. In some embodiments, the method includes attaching a second mounting member to the first plate, where the mounting member and the second mounting member facilitate attaching the first plate to the extension arm at two points of attachment.

Figure 1:
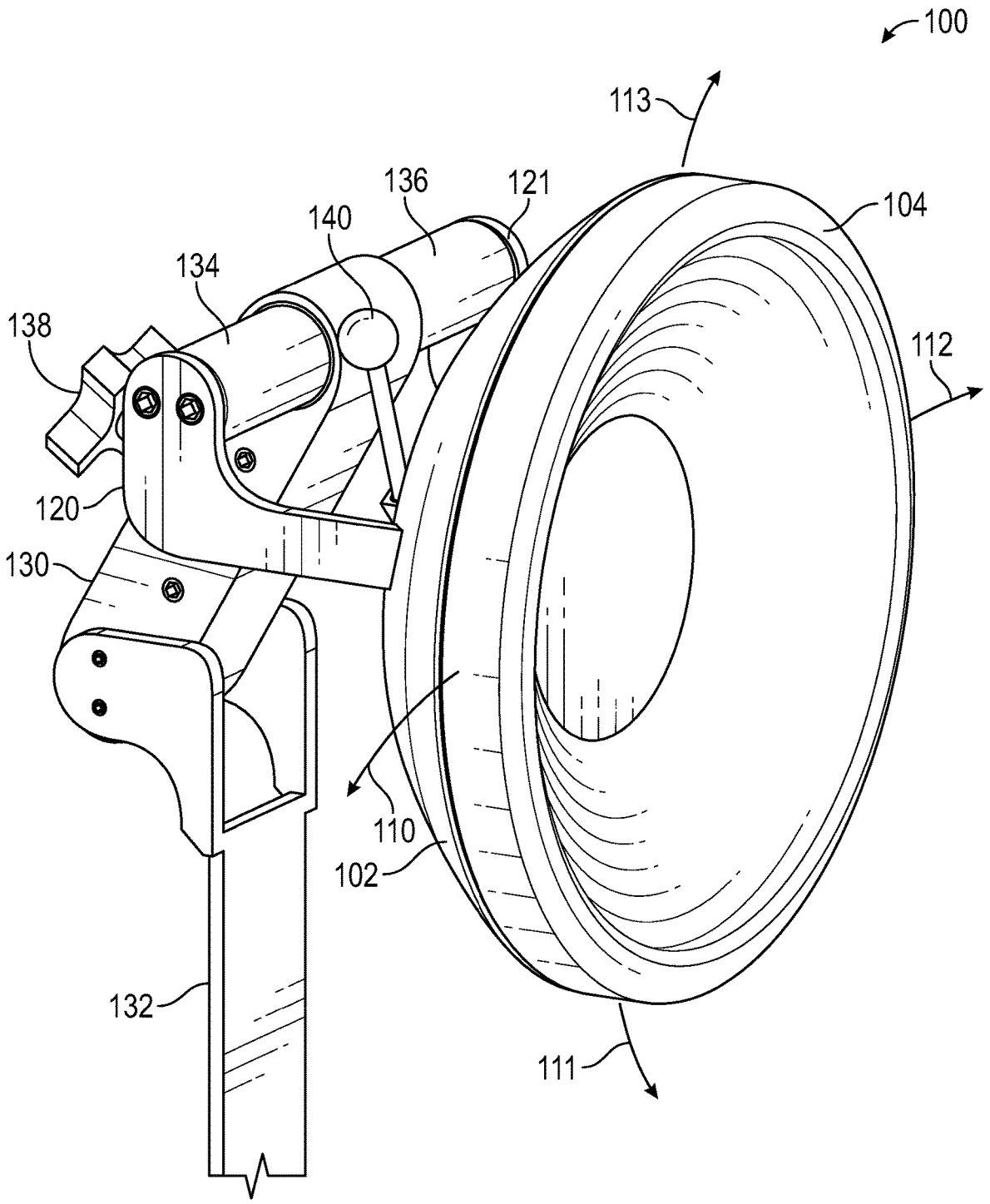
FIG. 1 is a perspective drawing depicting an embodiment of a headrest device.

While the disclosure is susceptible to various modifications and alternative forms, specific embodiments have been shown by way of example in the drawings and will be described in detail herein. However, it should be understood that the disclosure is not intended to be limited to the particular forms disclosed. Rather, the intention is to cover all modifications, equivalents and alternatives falling within the scope of the disclosure.

DETAILED DESCRIPTION

Disclosed herein is a headrest device that may include three domed plates, an outer compression plate, a center plate, and an inner compression plate stacked together. A foam headrest may be attached to the inner compression plate. The center domed plate may be configured to connect to a typical surgical head rest articulating extension arm, which can be adapted to fit surgical chairs. The outer and inner domed compression plates may be connected to each other via a bolt that runs through a large opening in the center domed plate. Thus, the outer and inner domed compression plates and the padded headrest may move in unison. The locking lever may be attached to a nut on the end of the bolt.

When the locking lever is released, the outer and inner dome compression plates may be free to move and swivel continuously in any direction up to the point that the bolt connecting the inner and outer plates contacts the edge of the opening in the middle plate. This movement may allow up-and-down and side-to-side movement, and may also allow for the patient's head to be positioned at various angles. Because the outer and inner plates move in unison, the operator may be able to position the patients head by moving either the outer compression plate via the locking lever or by directly moving the inner compression plate.

Once the operator has positioned the patient's head in the desired orientation, the locking lever may be tightened. By tightening the locking lever, the nut tightens on the bolt and the inner and outer plates may be pulled together against the middle plate. This may create frictional contact between the plates and may lock the headrest position.

Referring to FIG. 1, an embodiment of a headrest device 100 is depicted. The device 100 may include a first plate 102, a padded headrest 104, and a locking mechanism 140. The locking mechanism 140 may be movable between a locked state and an unlocked state. While the locking mechanism 140 is in the locked state, the padded headrest 104 may be prevented from moving relative to the first plate 102. While the locking mechanism is in the unlocked state, the padded headrest 104 may be free to shift relative to the first plate 102. Although the locking mechanism is depicted as being or including a lever, other configurations are possible. Further, although not shown in FIG. 1, additional plates and features may be included within the device 100 and are further described herein.

Due to the curvature of the first plate 102, while in the unlocked state, the padded headrest 104 may shift along a curved pathway, resulting in a change of angle of the padded headrest 104 relative to the first plate 102. The shifting of the padded headrest 104 may be in any direction along the curved pathway. For example, the padded headrest 104 may shift in an up-or-down direction, as shown by arrows 111, 113, or a side-to-side direction, as shown by arrows 110, 112, or combinations thereof.

The device 100 may be configured to attach to an extension arm 130. The extension arm 130 may be associated with a bed or chair, such as an operating or surgical bed or chair. The features and elements described, with respect to the extension arm 130, are for example purposes. Other types of extension arms and configurations are possible.

The extension arm 130 may include a release knob 138. The release knob 138 may be loosened to enable movement of the device 100 relative to the extension arm 130 and/or to enable movement of the extension arm 130 relative to a base member 132. The release knob 138 may be tightened to lock the device 100 in place relative to the extension arm 130. Thus, the extension arm 130 may be an articulating extension arm.

Spacer structures 134, 136 may be used to connect the extension arm 130 to the device 100. The device 100 may include a first mounting member 120 and a second mounting member 121 to connect the device 100 to the extension arm 130 (via the spacer structures 134, 136). The first mounting member 120 and the second mounting member 121 may be attached to the first plate 102.

A benefit of the device 100 is that by enabling movement of the padded headrest 104 in any direction along the curvature of the first plate 102, flexion, extension, and side-to-side articulation may be achieved, in contrast to typical surgical or operational headrests that may be limited by hinges that can only rotate along one axis. Other advantages may exist.

Figure 2:
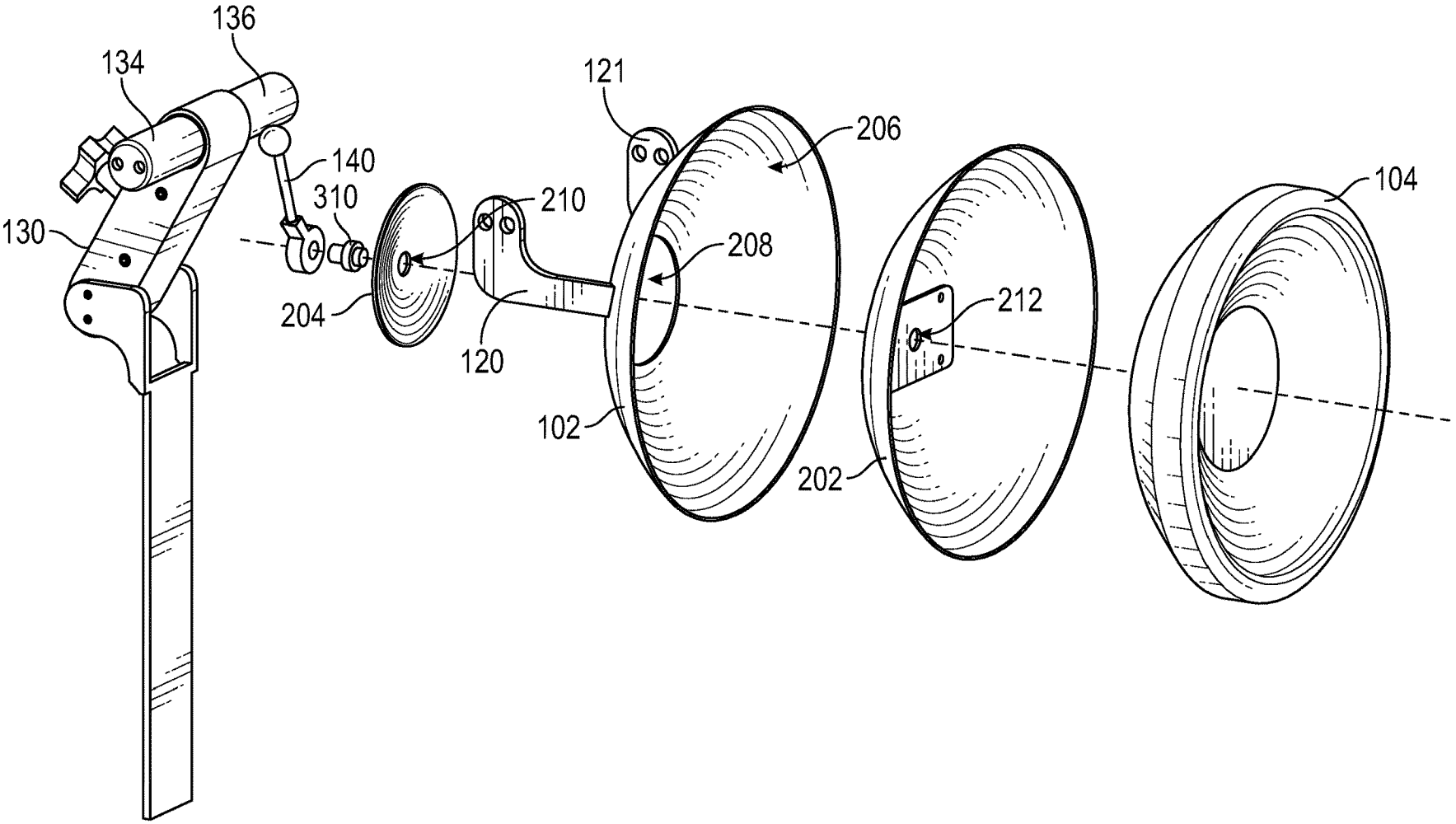
FIG. 2 is an exploded view drawing depicting an embodiment of a headrest device.

Referring to FIG. 2, an exploded view of an embodiment of the headrest device 100 is depicted. As seen in FIG. 2, the padded headrest 104 may attach to a second plate 202. The second plate 202 may be positioned against a surface 206 of the first plate 102. A third plate 204 may be positioned against the first plate 102 opposite the second plate 202. The first plate 102 may connect to the extension arm 130 via the mounting members 120, 121 and the spacer structures 134, 136.

When assembled, a clamping bolt 310 may attach to the locking mechanism 140 and pass through an opening 210 in the third plate 204, an opening 208 in the first plate 102, and an opening 212 in the second plate 202 where it may be attached to the second plate. In the embodiment depicted in FIG. 2, the locking mechanism 140 may be, or may include, a lever that, when rotated in a first direction, tightens the clamping bolt and causes a clamping force between the second plate 202 and the third plate 204. In this locked state, the clamping force may generate sufficient friction to prevent the second plate 202 from shifting along the surface 206 of the first plate 102.

When rotated in a second direction, the locking mechanism 140 may loosen the clamping bolt and may release the clamping force. This may enable the second plate 202 to shift along the surface 206 of the first plate 102. The second plate 202 may shift in any direction along the surface 206 and is only bounded by the point at which the clamping bolt contacts the perimeter of the opening 208 in the first plate 102. As depicted in FIG. 2, the surface 206 may be concave surface. Thus, shifting the second plate 202 may result in both a relative planar translation and an angular rotation of the second plate 202, which may also translate and rotate the padded headrest 104 because it is attached to the second plate 202.

The first plate 102 may be considered a center plate because it is positioned between the second plate 202 and the third plate 204. The second plate 202 may be considered an inner compression plate because the surface 206 of the first plate 102 may be concave and the second plate 202 may fit inside the curvature of the first plate 102. The third plate 204 may be considered an outer compression plate because it is positioned outside the curvature of the first plate 102. Both the second plate 202 and the third plate 204 may be considered compression plates because the locking mechanism 140 may apply a clamping force to the second plate 202 and the third plate 204 that compresses the first plate 102 between them. As used herein, the terms "inner," "outer," and "center," are not used in a relative sense. Rather, they are used only to distinguish the first plate 102, the second plate 202, and third plate 204, from each other.

Figure 3:
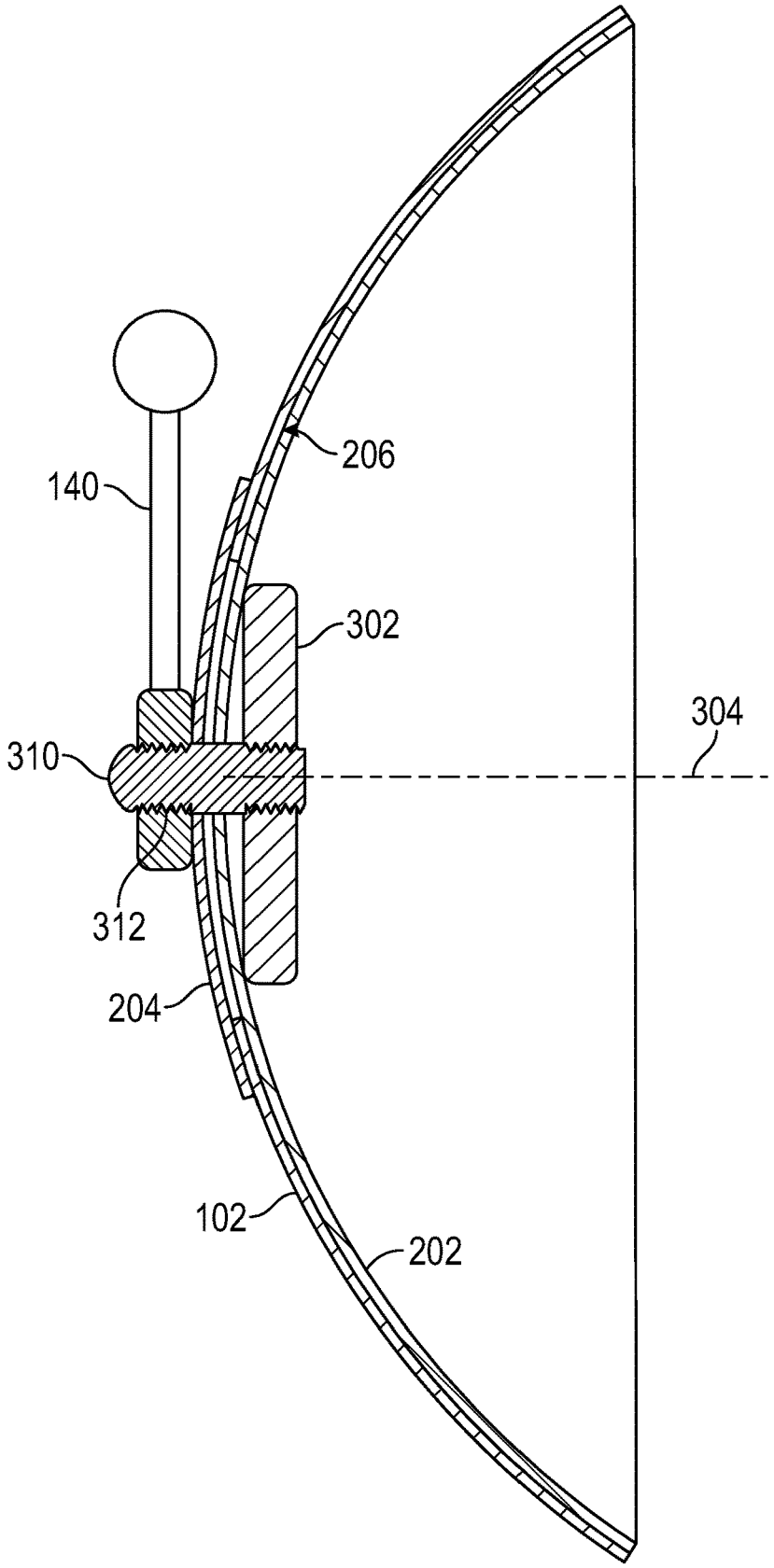
FIG. 3 is a cross-section view drawing depicting an embodiment of a headrest device with a centered inner plate.

Referring to FIG. 3, a cross-section view of portions of an embodiment of the device 100 are depicted. For clarity, FIG. 3 does not depict the padded headrest 104, the extension arm 130, or the mounting members 120, 121. The first plate 102 may be bowl shaped, having a surface 206, that may be concave. The second plate 202 may be positioned within the concavity of the first plate 102 along the surface 206. The third plate 204 may be positioned opposite the second plate 202 relative to the first plate 102. The plates 102, 202, 204 may be held together by a clamping bolt 310. The clamping bolt may connect to a bracket 302, which may be attached to the second plate 202. In some embodiments, the clamping bolt 310 may attach directly to the second plate 202. The clamping bolt 310 may pass through the first plate 102, the second plate 202, and the third plate 204 and may be attached to the locking mechanism 140. The clamping bolt 310 may include threading 312 that results in tightening a clamping force between the second plate 202 and the third plate 204 when the locking mechanism 140 is rotated in a first direction, and loosening the clamping force when the locking mechanism 140 is rotated in a second direction, opposite the first direction.

As shown in FIG. 3, when the first plate 102 and the second plate 202 are centered, they have a shared principal axis 304. However, by unlocking the locking mechanism 104 and shifting the second plate 202 along the surface 206, an angle between the first plate 102 and the second plate 202 may be changed.

Figure 4:
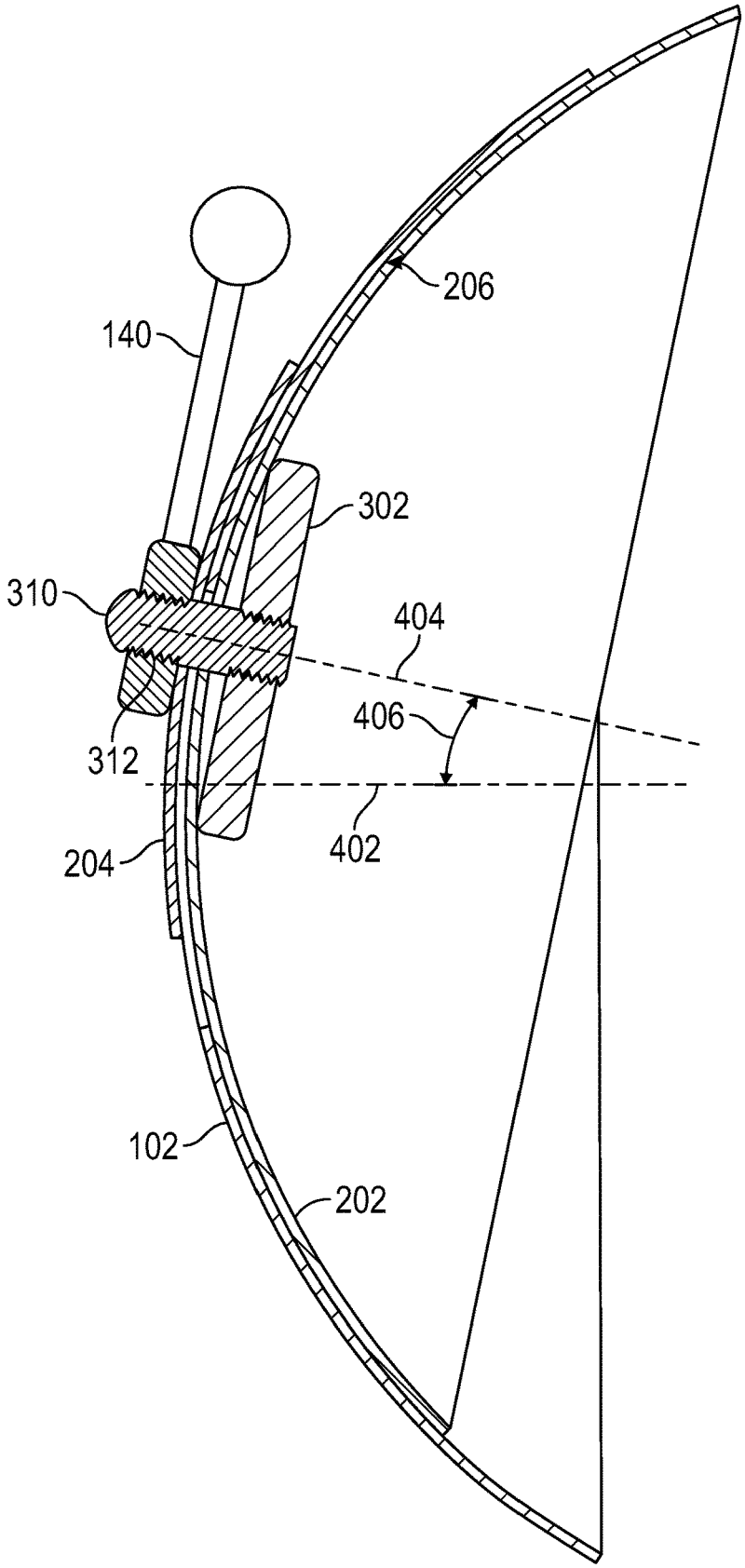
FIG. 4 is a cross-section view drawing depicting an embodiment of a headrest device with a shifted inner plate.

Referring to FIG. 4, a cross-section view of portions of an embodiment of the device 100 are depicted after the second plate 202 has been shifted relative to the first plate 102. As shown in FIG. 4, the first plate 102 may remain stationary, while the second plate 202, the third plate 204, the clamping bolt 310, and the locking mechanism 140 are shifted. A principal axis 402 of the first plate 102 may correspond to the shared principal axis 304 of FIG. 3. However, in FIG. 4, a principle axis 404 of the second plate 202 may be shifted and rotated relative to the principal axis 304. In other words, shifting the second plate 202 along the surface 206 of the first plate 102 may change an angle 406 between the principal axis of the first plate 102 and the principal axis 404 of the second plate 202. As shown in FIG. 4, a lateral translation may also occur.

FIGS. 3 and 4 demonstrate a benefit of the device 100 in that only a single locking mechanism 140 may be used to make both lateral and angular adjustments of a headrest. Other advantages may exist.

Figure 5:
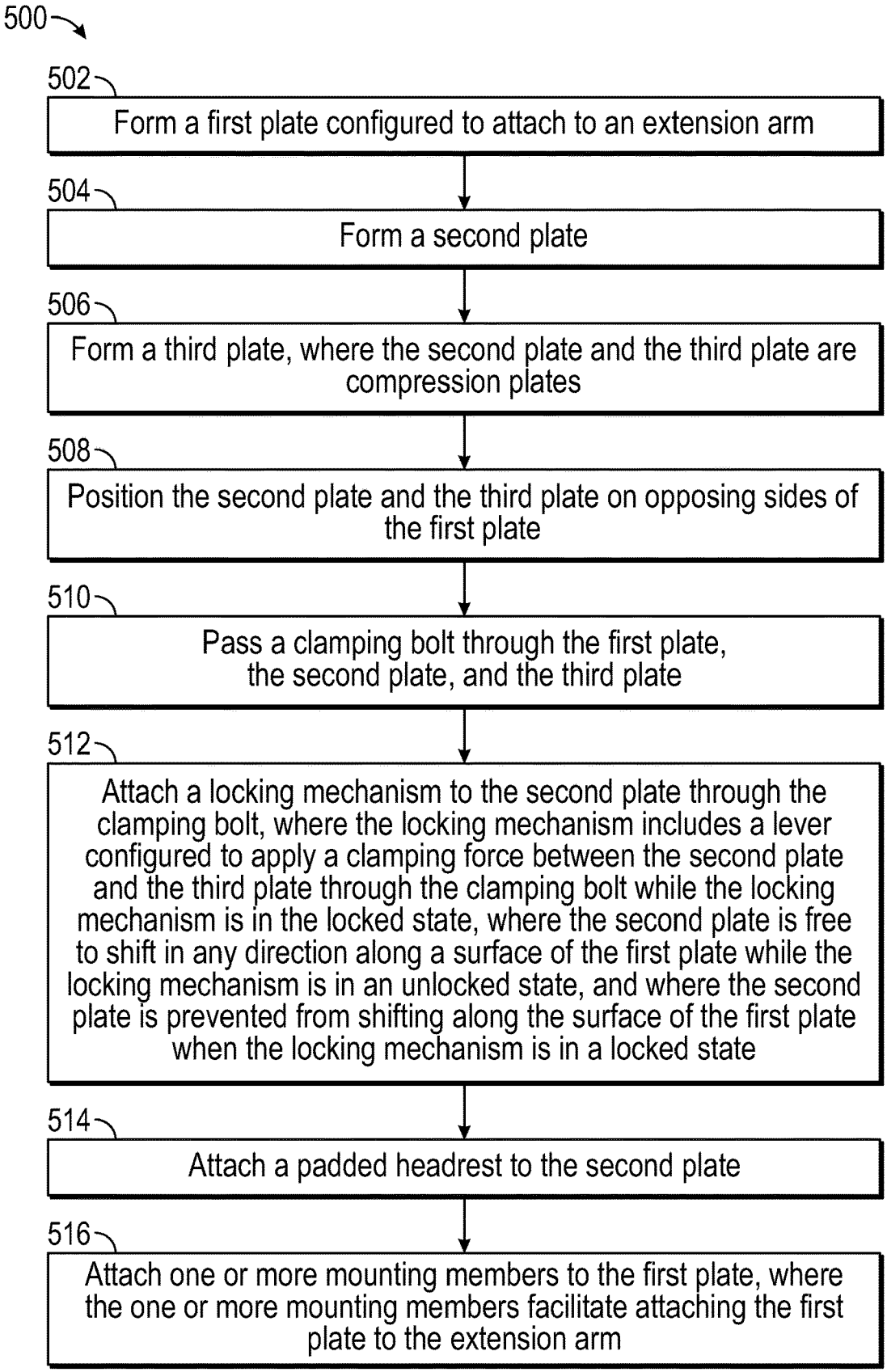
FIG. 5 is a flowchart depicting an embodiment of a method of forming a headrest device.

Referring to FIG. 5, an embodiment of a method 500 of forming a headrest device is depicted. The method 500 may include forming a first plate configured to attach to an extension arm, at 502. For example, the first plate 102 may be formed.

The method 500 may further include forming a second plate, at 504. For example, the second plate 202 may be formed.

The method 500 may also include forming a third plate, where the second plate and the third plate are compression plates, at 506. For example, the third plate 204 may be formed.

The method 500 may include positioning the second plate and the third plate on opposing sides of the first plate, at 508. For example, the second plate 202 and the third plate 204 may be positioned on opposite sides of the first plate 102.

The method 500 may further include passing a clamping bolt through the first plate, the second plate, and the third plate, at 510. For example, the clamping bolt 310 may pass through the first plate 102, the second plate 202 and the third plate 204.

The method 500 may also include attaching a locking mechanism to the second plate through the clamping bolt, where the locking mechanism includes a lever configured to apply a clamping force between the second plate and the third plate through the clamping bolt while the locking mechanism is in the locked state, where the second plate is free to shift in any direction along a surface of the first plate while the locking mechanism is in an unlocked state, and where the second plate is prevented from shifting along the surface of the first plate when the locking mechanism is in a locked state, at 512. For example, the locking mechanism 140 may be attached to the second plate 202 via the clamping bolt 310.

The method 500 may include attaching a padded headrest to the second plate, at 514. For example, the padded headrest 104 may be attached to the second plate 202.

The method 500 may further include attaching one or more mounting members to the first plate, where the one or more mounting members facilitate attaching the first plate to the extension arm, at 516. For example, the mounting members 120, 121 may be attached to the first plate 102.

Figure 6:
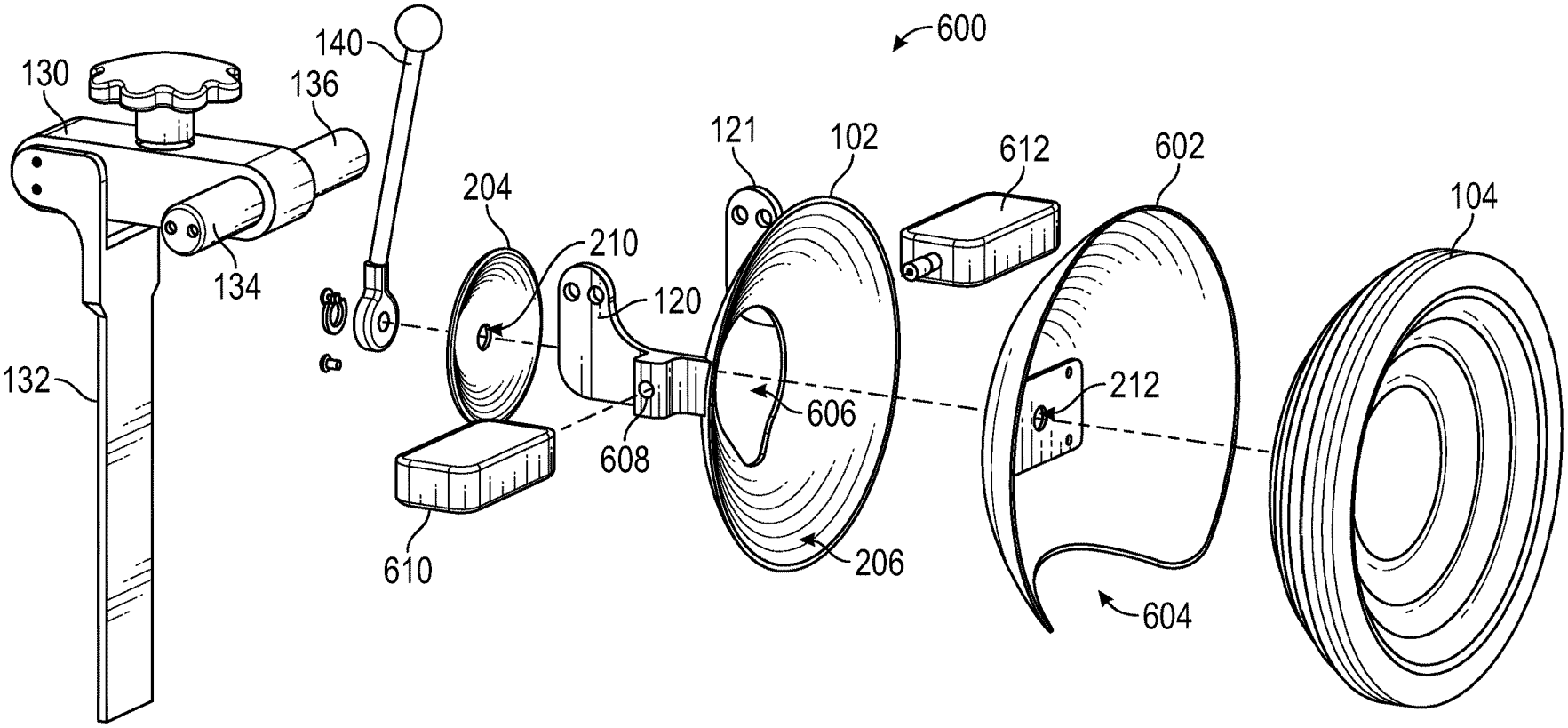
FIG. 6 is an exploded view drawing depicting an embodiment of a headrest device.

Referring to FIG. 6, an exploded view of an embodiment of a headrest device 600 is depicted. The device 600 may be similar to the device 100 and may include many of the same components. For example, the device 100 may include the first plate 102, the padded headrest 104, the locking mechanism 140, and the third plate 204. The device 600 may also include the first mounting member 120 and the second mounting member 121. As with the device 100, the device 600 may be attachable to an extension arm 130.

The extension arm 130 may include a release knob 138. The release knob 138 may be loosened to enable movement of the device 100 relative to the extension arm 130 and/or to enable movement of the extension arm 130 relative to a base member 132. The release knob 138 may be tightened to lock the device 100 in place relative to the extension arm 130. Thus, the extension arm 130 may be an articulating extension arm. Also, like the device 100, spacer structures 134, 136 may be used to connect the extension arm 130 to the device 600.

The device 600 may include a second plate 602. The second plate 602 may have a larger spherical cap radius than the first plate 102. The larger radius may enable the angle of the second plate 602 to be changed relative to the first plate 102 without the first plate 102 significantly extending past an edge of the second plate 602. This may prevent the first plate 102 from interfering with the edge of the second plate 602 or with anything near the edge of the second plate 602.

The second plate 602 may further include an indentation 604 formed therein to accommodate a patient's neck. For example, the second plate 602 is slid downward relative to the first plate 102, resulting in both the second plate 602 and the padded headrest 104 being tilted upward, a patient's neck may fit within the indentation 604. This may provide more comfort to a patient by not interfering with or "digging in" to the patient's neck.

As shown in FIG. 6, an opening 606 in the first plate 102 may be elongated. This may enable the second plate 602 and the padded headrest 104 to tilt to a greater angle in at least one direction than in other directions. For example, the angle of tilt of the second plate 602 may be limited by a point at which the clamping bolt (shown in FIGS. 2-4) interferes with an edge of the opening 606. By elongating the opening 606 downward as shown in FIG. 6, the second plate 602 and the padded headrest 104 may tilt further in an upward direction than in a downward direction or side-to-side directions.

The device 600 may also include a first fore-arm support 610 attached to a support coupling 608 positioned on the first mounting member 120. A second fore-arm support 612 may be attached to a second support coupling (not shown) positioned on the second mounting member 120. The fore-arm supports 610, 612 may facilitate holding a patient's head. For example, a particular operation may involve a procedure known as "chinning," where a practitioner may rest their forearms on the fore-arm supports 610, 612 to hold a patient's head up around the chin area.

As described herein, the device 600 may include several features and advantages that are not included in the device 100. However, the disclosure is not intended to be limited to any particular embodiment. Combinations of features described herein are considered within the scope of the disclosure. Further, although various embodiments have been shown and described, the present disclosure is not so limited and will be understood to include all such modifications and variations as would be apparent to one skilled in the art.

What is claimed is:

1. A headrest device comprising:

a center plate configured to attach to an extension arm, wherein the center plate has a concave surface and a convex surface;

an inner compression plate positioned on a first side of the center plate, wherein the inner compression plate has a convex surface configured to engage the concave surface of the center plate;

a padded headrest attached to the inner compression plate;

an outer compression plate positioned on a second side of the center plate opposite the first side of the center plate, wherein the outer compression plate has a concave surface configured to engage the convex surface of the center plate; and a lever that is movable between a locked state and an unlocked state, wherein the lever applies a clamping force between the inner compression plate and the outer compression plate when in the locked state, wherein the inner compression plate is free to shift in any direction along the concave surface of the center plate while the lever is in the unlocked state, and wherein the inner compression plate is prevented from shifting along the concave surface of the center plate when the lever is in the locked state.

2. The device of claim 1, wherein shifting the inner compression plate along the concave surface of the center plate changes an angle between a principle axis of the center plate and a principle axis of the inner compression plate.

3. The device of claim 1, further comprising a clamping bolt passing through the outer compression plate and the inner compression plate, wherein the clamping force is applied to the outer compression plate and the inner compression plate through the clamping bolt.

4. The device of claim 1, further comprising one or more mounting members attached to the center plate, wherein the mounting members facilitate attaching the center plate to the extension arm.

5. The device of claim 4, further comprising one or more fore-arm supports attached to the one or more mounting members, wherein the fore-arm supports facilitate holding a patient's head.

6. The device of claim 1, wherein a spherical cap radius of the inner compression plate is greater than a spherical cap radius of the center plate.

7. The device of claim 1, wherein the inner compression plate includes an indentation formed therein to accommodate a patient's neck.

8. The device of claim 1, wherein the opening in the center plate is elongated to enable the padded headrest to tilt at a greater angle in at least one direction than in other directions.

9. A headrest device comprising:

a first plate configured to attach to an extension arm, the first plate having a concave surface and a convex surface;

a second plate having a convex surface configured to engage the concave surface of the first plate; and a locking mechanism, wherein the second plate is free to shift in any direction along the concave surface of the first plate while the locking mechanism is in an unlocked state, and wherein the second plate is prevented from shifting along the concave surface of the first plate when the locking mechanism is in a locked state, and a padded headrest attached to the second plate.

10. The device of claim 9, wherein shifting the second plate along the concave surface of the first plate changes an angle between a principle axis of the first plate and a principle axis of the second plate.

11. The device of claim 9, further comprising a third plate, wherein the second plate and the third plate are compression plates positioned on opposing sides of the first plate, and wherein the locking mechanism includes a lever configured to apply a clamping force between the second plate and the third plate while the locking mechanism is in the locked state.

12. The device of claim 11, further comprising a clamping bolt passing through the second plate and the third plate, wherein the clamping force is applied to the second plate and the third plate through the clamping bolt.

13. The device of claim 9, further comprising one or more mounting members attached to the first plate, wherein the mounting members facilitate attaching the first plate to the extension arm.

14. The device of claim 13, further comprising one or more fore-arm supports attached to the one or more mounting members, wherein the fore-arm supports facilitate holding a patient's head.

15. The device of claim 9, wherein a spherical cap radius of the second plate is greater than a spherical cap radius of the first plate, and wherein the second plate includes an indentation formed therein to accommodate a patient's neck.

16. The device of claim 9, wherein the opening in the first plate is elongated to enable the padded headrest to tilt at a greater angle in at least one direction than in other directions.

* * * * *